United States Patent [19]

Aron

[11] 4,248,478

[45] Feb. 3, 1981

[54] SELF-SUPPORTING INFANT CHAIR

[76] Inventor: Leonard Aron, 2390 Janis, Palm Springs, Calif. 92262

[21] Appl. No.: 60,180

[22] Filed: Jul. 24, 1979

[51] Int. Cl.[3] ..... A47B 39/00

[52] U.S. Cl. ..... 297/174; 297/DIG. 2; 297/134

[58] Field of Search ..... 297/174, 134, DIG. 2; 264/238; 403/265, 269

[56] References Cited

U.S. PATENT DOCUMENTS

| | | | |
|---|---|---|---|
| Re. 23,339 | 2/1951 | Ducey . | |
| 2,451,667 | 10/1948 | Ducey . | |
| 2,707,987 | 5/1955 | Gibson . | |
| 2,710,643 | 6/1955 | Wincey et al. . | |
| 3,052,500 | 9/1962 | Hyde . | |
| 3,059,965 | 10/1962 | Fornetti | 297/174 |
| 3,126,226 | 3/1964 | Johnson | 297/174 |
| 3,132,895 | 5/1964 | Dollington | 297/134 |
| 3,133,760 | 5/1964 | Robinson | 297/174 |
| 3,190,691 | 6/1965 | Desjardins | 297/134 X |
| 3,222,104 | 12/1965 | Remington et al. | 297/134 |
| 3,243,229 | 3/1966 | Barnhill | 297/134 |
| 3,253,860 | 5/1966 | Shapiro | 297/174 X |
| 3,476,496 | 11/1969 | Golden | 403/269 |
| 4,164,523 | 8/1979 | Hanning | 264/328 |

FOREIGN PATENT DOCUMENTS

| | | | |
|---|---|---|---|
| 446640 | 3/1968 | Switzerland | 297/174 |

*Primary Examiner*—James T. McCall

[57] ABSTRACT

A self-supporting table infant chair includes back, seat, and sidewall portions integrally formed from thermoplastic resin material by means of injection molding techniques so as to form a one-piece bucket-type chair. An upper set of laterally spaced support arms are secured within armrest portions of the chair, and a lower support arm is centrally secured within the seat portion of the chair. The upper set of arms cooperate with the lower arm so as to define a horizontal channel therebetween within which a projection portion of a dining table is to be disposed and from which the chair will be supported by means of the support arms. The proximal ends of the support arms are crimped so as to define laterally extending, flattened ears which then become embedded within the molded armrest and seat portions of the chair whereby translational and rotational movement of the support arms, along and about three mutually orthogonal axes, respectively, is positively prevented.

15 Claims, 3 Drawing Figures

SELF-SUPPORTING INFANT CHAIR

FIELD OF THE INVENTION

The present invention relates generally to infant chairs, and more particularly to infant chairs which are particularly adapted to be self-supporting from a table surface.

BACKGROUND OF THE INVENTION

It is usually desirable for a young child to eat at a table at which adults are dining in order to permit one of the adults to assist the child in the eating process, as well as to facilitate the development by the child of proper eating habits. While conventional floor-supported infant chairs, or "high-chairs", are of course well-known, such chairs do not permit the child to dine at the dining table due to the fact that the elevated seat structure cannot be accommodated beneath the dining table. Consequently, the child does not in fact dine at the dining table but only within the vicinity of the table. As a result, proper assistance and instruction for the child is not conveniently administered.

Other infant chairs have of course been marketed within recent years in order to overcome the aforenoted disadvantages of conventional "high-chairs", and it is particularly noted that one general type of such improved infant chairs is able to be self-supporting from the dining table. As a result of such structure, the child is able to be ideally positioned relative to the dining table in order to facilitate the eating process of the child in a manner quite similar to the eating process performed by the dining adults.

Such self-supporting chairs usually comprise an upper set of laterally spaced arms, and a lower set of one or more arms which cooperate with the upper set of arms so as to define a channel therebetween into which a projecting edge portion of the dining table is disposed. In this manner, the table surface defines the sole supporting structure for the chair which is, in turn, supported from the table in, in effect, a cantilevered manner.

A serious drawback of the aforenoted self-supporting infant chairs has proven to be the manner in which the support arms are secured to or within the chair. In such conventional chairs, the arms are often secured to the chairs simply by means of nut-and-bolt assemblages, wing nut-and-bolt assemblages, and the like. Experience has proven that with usage, the nut-and-bolt assemblies tend to loosen, the nuts become lost, and the bolts withdraw. The assemblages are no longer rigidified and they become unsafe for the infant child in view of the fact that the rigid structures are self-supporting. The non-rigid structure obviously cannot support the loads impressed thereon by means of the infant's weight. In a similar manner, other conventional chairs of the same type have their arms secured within the chair framework simply by means of a slidable, friction-type fitting. This manner of securing the arms within the chair framework is likewise unsatisfactory for experience has likewise proven that within a particular period of time, the support arms have withdrawn from their support structures due to the various stress forces, bending moments, and the like impressed thereon.

OBJECTS OF THE INVENTION

Accordingly, it is an object of the present invention to provide a new and improved infant chair.

Another object of the present invention is to provide a new and improved infant chair of the type which is self-supporting with respect to a table surface.

Still another object of the present invention is to provide a new and improved self-supporting table infant chair which overcomes the various disadvantages of conventional self-supporting table infant chairs.

Yet another object of the present invention is to provide a new and improved self-supporting table infant chair wherein the support structure for the chair is rigidly secured within the chair framework whereby the chair may safely support the infant child.

Still yet another object of the present invention is to provide a new and improved self-supporting table infant chair wherein the support structure for the chair is rigidly secured within the chair framework and cannot become disjointed therefrom under normal loads and stresses impressed thereon.

Yet still another object of the present invention is to provide a new and improved self-supporting table infant chair wherein the support structure, while exhibiting a predetermined degree of flexibility in order to permit the chair to be operatively mounted upon the supporting table, is rigidly secured within the chair framework so as not to be movable along any one of three mutually orthogonal axes.

A further object of the present invention is to provide a new and improved self-supporting table infant chair wherein the support structure, while exhibiting a predetermined degree of flexibility in order to permit the chair to be operatively mounted upon the supporting table, is rigidly secured within the chair framework so as not to be rotatable about any one of three mutually orthogonal axes.

A still further object of the present invention is to provide a new and improved self-supporting table infant chair wherein the support structure, while exhibiting a predetermined degree of flexibility in order to permit the chair to be operatively mounted upon the supporting table and to be capable of withstanding bending stresses or moments impressed thereon as a result of the weight load of the infant and other extraneous forces, nevertheless exhibits a predetermined degree of rigidity whereby the structure is not permanently deformed or fractured.

A yet further object of the present invention is to provide a new and improved self-supporting table infant chair wherein the infant support structure is fabricated of a strong and durable material so as to safely support the infant child.

A still yet further object of the present invention is to provide a new and improved self-supporting table infant chair wherein the infant support structure is fabricated of a strong and durable material so as to safely support infant children of various weights and ages.

A yet still further object of the present invention is to provide a new and improved self-supporting table infant chair wherein the infant support structure is fabricated of a strong and durable material so as to safely support weight loads several times greater than the weight of the average infant child who would normally be seated within such a chair.

An additional object of the present invention is to provide a new and improved self-supporting table infant chair which may be economically manufactured by mass production techniques.

A still additional object of the present invention is to provide a new and improved self-supporting table infant chair which, in conjunction with its high-strength, high impact resistance, and high load-supporting properties, is substantially light-weight.

A yet additional object of the present invention is to provide a new and improved self-supporting table infant chair which is simplified in its construction.

SUMMARY OF THE INVENTION

The foregoing and other objectives are accomplished in accordance with the present invention through the provision of a self-supporting table infant chair which comprises seat, back, and side portions integrally formed from a suitable thermoplastic resin material, such as, for example, ABS, by means of injection molding techniques. An upper set of laterally spaced support arms are secured within armrest portions of the chair, and a lower support arm is centrally secured within the seat portion of the chair. The upper set of support arms cooperate with the lower support arm so as to define a horizontal channel therebetween within which a projecting portion of a dining table is to be disposed and from which the chair will be supported by means of the support arms.

In order to insure that the support arms are fixedly secured within the chair so as not to be capable of being loosened or disjointed therefrom, the proximal end of each support arm is crimped so as to define laterally extending ear portions. In fabricating the chair of the present invention by means of, for example, injection molding techniques, the proximal ends of the support arms will be disposed within the mold, and the chair will be subsequently molded in accordance with the aforenoted conventional injection molding techniques. As a result, the proximal ends of the support arms, with the crimped ear portions thereof, will be embedded within the molded armrest and seat portions of the chair. In view of the fact that the molded plastic material completely encapsulates the proximal ends of the support arms, and particularly the laterally extending ear portions thereof, the support arms cannot be removed from the aforenoted portions of the chair, and likewise, the support arms cannot be pivoted or rotated within the chair portions. The support arms are thus fixedly secured within the self-supporting chair of the present invention with respect to three mutually orthogonal axes, and with respect to axial movement along such axes as well as with respect to rotational movements about such axes.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several view, and wherein.

DETAILED DESCRIPTION OF THE PREFERRED EMBODIMENT

Figure 1:
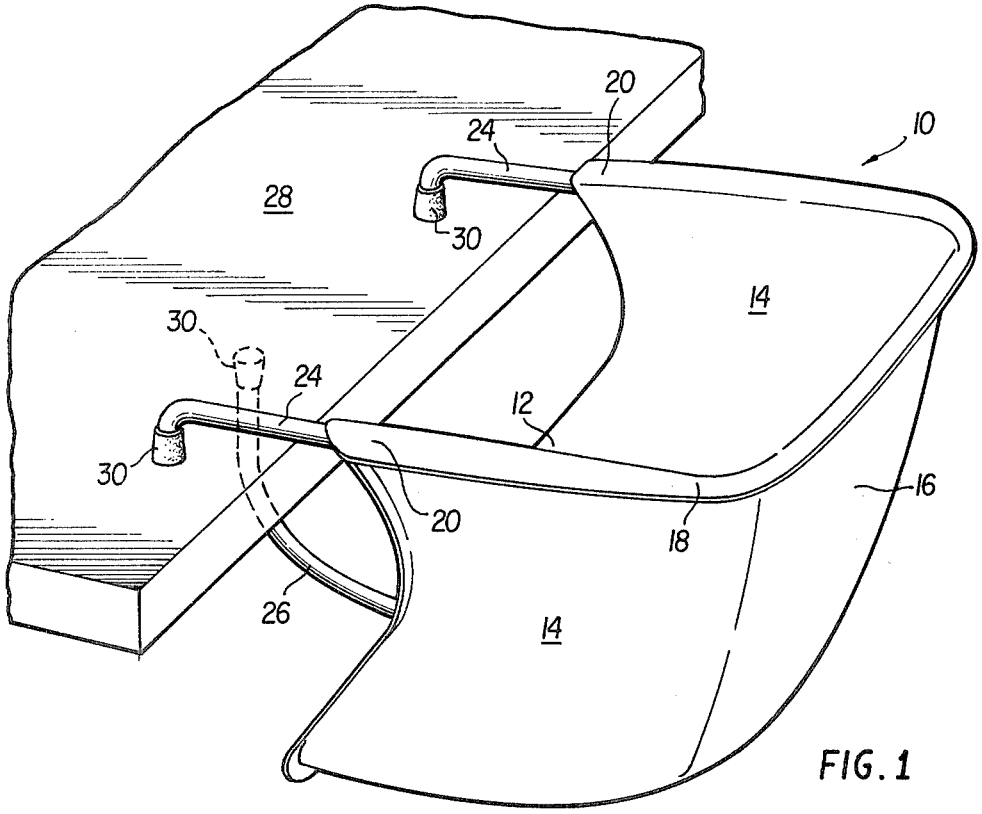
FIG. 1 is a perspective view showing the self-supporting chair of the present invention mounted upon a dining table surface in its operative position.

Referring now to the drawings, and more particularly to FIG. 1 thereof, the self-supporting table infant chair of the present invention is disclosed and is generally indicated by the reference character 10. As can be readily seen, the chair is of the bucket type and comprises a seat portion 12, sidewalls 14, and a back portion 16. The seat, sidewall, and back portions of the chair are integrally formed and connected together such that the chair body is defined by a single-piece construction.

The chair body may be easily fabricated of a suitable thermoplastic resin material by conventional injection molding techniques. Such processing enables the chairs to be economically produced by mass production techniques due to the fact that injection molding permits a substantial number of articles to be reproduced from a single mold. In addition, the articles produced exhibit good consistency with respect to each other, and problems do not arise with respect to, for example, reproducing articles of different colors in order to meet particular consumer demands.

In view of the particular operative mode within which the chair of the present invention is to be utilized, the particular thermoplastic resin material selected must exhibit certain required and desired characteristics, such as, for example, high impact resistance, high strength, light weight, and good appearance and maintenance properties. Polyethylene or polypropylene are satisfactory materials, however, an acrylonitrile-butadienestyrene (ABS) material is preferred. Such plastic material exhibits good dimensional stability over wide temperature ranges, and the same is characterized by good tensile and flexural strength. The material is readily commercially available, and one particular type of such material is commercially marketed by the Borg-Warner Chemical Corporation as CYCOLAC T.

Figure 2:
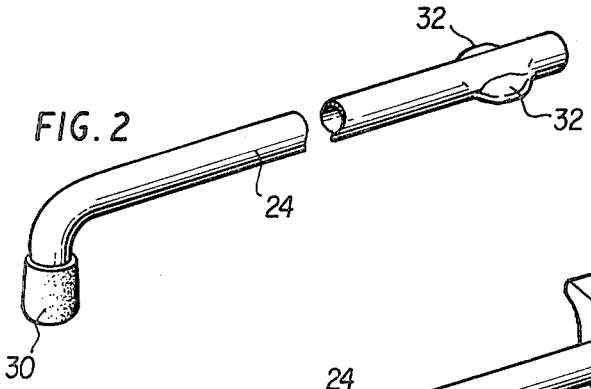
FIG. 2 is a perspective view of a support arm of the chair of the present invention.
Figure 3:
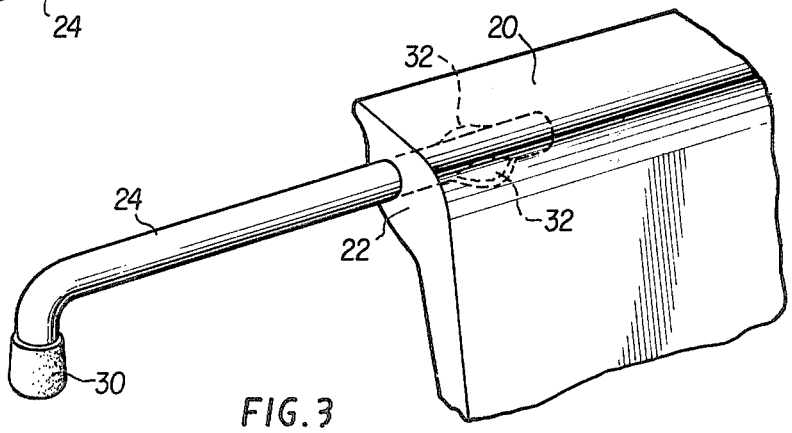
FIG. 3 is a perspective view illustrating in detail how the support arms are mounted within the chair of the present invention.

The chair 10 is provided with a peripherally extending lip 18 formed upon the upper edges of the sidewalls 14 and the back portion 16, and it is seen that the forward portions of lip 18 which extend along the sidewalls 14 are somewhat laterally extended so as to define armrest portions 20. In addition, as may be appreciated from FIG. 3, a beaded portion 22 is integrally formed along the underside of each armrest 20 in order to house the proximal end of an upper support arm 24 of the chair. Each support arm 24 comprises a metal tubular member, as best seen in FIG. 2, having a substantially L-shaped configuration. The long leg of each arm has its proximal end secured within beaded portion 22, while the short leg of each arm projects downwardly. In a similar manner, the chair 10 is likewise provided with a lower support arm 26 which has one end thereof secured within the forwardmost portion of the chair seat 12. As seen from FIG. 1, lower support arm 26 has an arcuate configuration such that the distal end thereof projects upwardly. The ends of the short legs of support arms 24 terminate within a plane disposed somewhat above the terminal end point of lower support arm 26, and in this manner, a horizontal space or channel is defined between the upper set of arms 24 and the lower arm 26 so as to be capable of receiving the projecting edge of a dining table 28 therebetween. The vertical spacing between the arms 24 and arm 26 is preferably less than the thickness of table 28 such that when the chair is mounted upon the table as a result of the lower ends of arms 24 engaging the upper surface of the table, while the upper end of lower arm 26 engages the undersurface of table 28, the support arms will tightly and frictionally engage the respective surfaces of the table. In order to prevent marring of the table surfaces, as well as to increase the frictional engagement of the arms 24 and 26 with respect to the table surfaces, the terminal ends of the arms may be provided with rubber cushion tips or caps 30.

As noted hereinbefore, the arms 24 and 26 are fabricated of metal tubing, and the particular metal chosen may be, for example, steel, aluminum, or the like. It is desirable to render the support arms as light in weight as possible, yet of sufficient strength capable of withstanding the various bending moments and stresses, as well as weight and extraneous force loads, which will undoubtedly be impressed upon such support structure during the operative use of the infant chair. It has been found, for example, that while steel is heavier than aluminum, the strength properties of steel are greater than those of aluminum. Consequently, in fabricating the tubular members employed in making the support arms of the chair of the present invention, the wall thickness of the tubing may be less in the case of steel tubing than that of aluminum tubing. Consequently, substantially similar weight characteristics may be exhibited from both steel and aluminum tubing in view of the fact that the wall thickness of the aluminum tubing must be greater than that of the steel tubing in order to achieve comparable strength properties.

As was also noted hereinbefore, the chair 10 of the present invention is fabricated by means of conventional injection molding techniques, and in order to fixedly secure the support arms 24 and 26 within the chair 10, the injection molding process for the chair encompasses the anchoring of the support arms wihin the chair. As specifically seen in FIGS. 2 and 3, the proximal ends of the support arms 24 are crimped so as to define a pair of laterally extending, flattened ears 32, it being further appreciated that similar processing is performed in conjunction with lower support arm 26. When the arms 24 and 26 are placed within the mold structure, not shown, and the chair 10 fabricated by means of the injection molding techniques, the beaded portions 22 of the chair sidewalls 14 will completely encapsulate the proximal ends of the arms 24 and 26 along with their ears 32 whereby the arms 24 and 26 will be securely anchored within the chair. It is preferred that the embedded length of each arm within the chair be approximately, or at least, three inches (3") in order to in fact provide a secure anchoring means capable of withstanding the bending and load stresses and forces that will be impressed upon the support arms. As a result of such encapsulation of the arm ends within the chair sidewalls, it will be readily appreciated, particularly in view of the embedment of the anchoring means 32 within the chair sidewalls, that the support arms 24 and 26 are fixed relative to the chair 10 and cannot move along any one of three mutually orthogonal axes, including an axis directed along the longitudinal extent of each of the arms 24, for example, as well as along either of two axes perpendicular thereto. More particularly, each arm is prevented from moving vertically, laterally, or axially. In this manner, the arms cannot be removed from the chair sidewalls.

In a similar manner, it will likewise be appreciated that each of the arms 24 and 26 is prevented from rotating or pivoting about any of the aforenoted three mutually orthogonal axes. Of course there is a certain degree of flexibility characteristic of the cantilevered embedment of the arms within the chair body such that the arms may, for example, flex upwardly and downwardly, or laterally, or yet further, some compound motion thereof, however, the anchoring means 32, as well as the elongated embedment of the proximal ends of the arms within the chair body, positively prevents any rotation or pivoting of the support arms about any one of three mutually orthogonal axes.

Thus, it may be seen that the chair of the present invention has distinct advantages over known prior art self-supporting table infant chairs in that the support arms therefor are encapsulated and embedded within the molded chair structure so as to be fixedly anchored therein and incapable of translational movement along any of three mutually orthogonal axes, or of rotational or pivotal movement about any one of such three axes. In this manner, the support arm structure cannot become loosened or withdrawn from the chair structure as a result of which the chair structure is rendered safe for infants of varying sizes and weights, and under various operative stresses and load or weight forces. Removal or withdrawal of the support arm structure can only be accomplished through destruction of the chair body structure per se, however, in view of the good flexural and tensile stress and strength properties of the chair structure material, this is highly unlikely to occur.

Obviously, many modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. An infant chair adapted to be self-supporting from a horizontally disposed table surface, comprising:

a seat portion and a pair of sidewall portions;

first support arm means projecting outwardly from said sidewall portions of said chair;

second support arm means projecting outwardly from said seat portion of said chair;

solid thickened portions integrally formed with said pair of sidewall portions and said seat portion constituting the sole support means for said first and second support arm means, respectively;

free end portions of said first and second support arm means defining a horizontal channel therebetween within which said table surface is to be disposed and for engaging the upper and under surfaces of said table respectively; and the other end portions of said first and second support arm means being fixedly embedded within said solid thickened portions of said seat and sidewall portions of said chair and having means thereon for preventing longitudinal and rotational movement within and relative to said solid thickened portions of said seat and sidewall portions of said chair.

2. An infant chair adapted to be self-supporting from a horizontally disposed table surface, comprising:

a seat portion and a pair of sidewall portions;

first support arm means projecting outwardly from said sidewall portions of said chair;

second support arm means projecting outwardly from said seat portion of said chair;

solid thickened portions integrally formed with said pair of sidewall portions and said seat portion constituting the sole support means for said first and second support arm means, respectively;

free end portions of said first and second support arm means defining a horizontal channel therebetween within which said table surface is to be disposed and for engaging the upper and under surfaces of said table respectively; and the other end portions of said first and second support arm means being entirely fixedly secured interiorly within said solid thickened portions of said seat and sidewall portions of said chair and having means thereon for preventing longitudinal and rotational movement within and relative to said solid thickened portions of said seat and sidewall portions of said chair.

3. An infant chair adapted to be self-supporting from a horizontally disposed table surface, comprising:

a seat portion and a pair of sidewall portions;

first support arm means projecting outwardly from said sidewall portions of said chair;

second support arm means projecting outwardly from said seat portion of said chair;

solid thickened portions integrally formed with said pair of sidewall portions and said seat portion constituting the sole support means for said first and second support arm means, respectively;

free end portions of said first and second support arm means defining a horizontal channel therebetween within which said table surface is to be disposed and for engaging the upper and under surfaces of said table respectively; and the other end portions of said first and second support arm means being fixedly encapsulated within said solid thickened portions of said seat and sidewall portions of said chair and having means thereon for preventing longitudinal and rotational movement within and relative to said solid thickened portions of said seat and sidewall portions of said chair.

4. The infant chair as set forth in claim 3, wherein:

said preventing means comprises laterally extending ears.

5. The infant chair as set forth in claim 4, wherein:

said ears are crimped upon said other end portions.

6. The infant chair as set forth in claim 3, further comprising:

a back portion; and said back, seat, and sidewall portions are integrally formed as a one-piece structure.

7. The infant chair as set forth in claim 6, wherein:

said one-piece structure is injection molded.

8. The infant chair as set forth in claim 7, wherein:

said chair structure is fabricated from a thermoplastic resin material.

9. The infant chair as set forth in claim 8, wherein:

said thermoplastic resin material is ABS.

10. The infant chair as set forth in claim 3, further comprising:

arm rest means integral with said sidewall portions of said chair; and said solid thickened portions are integrally formed beneath said arm rest means.

11. The infant chair as set forth in claim 3, further comprising:

means secured to said free ends of said support arm means for preventing marring of said table surfaces.

12. The infant chair as set forth in claim 11, wherein:

said marring preventing means comprises rubber caps.

13. The infant chair as set forth in claim 3, wherein:

said first and second support arm means comprise tubular members.

14. The infant chair as set forth in claim 13, wherein:

said tubular members are fabricated of aluminum.

15. The infant chair as set forth in claim 13, wherein:

said tubular members are fabricated of steel.

* * * * *